US005191259A

United States Patent [19]

Hayashi et al.

[11] Patent Number: 5,191,259

[45] Date of Patent: Mar. 2, 1993

[54] FLUORESCENT DISPLAY APPARATUS WITH FIRST, SECOND AND THIRD GRID PLATES

[75] Inventors: Masatake Hayashi; Tsuneo Muchi; Minoru Ohzeki, all of Tokyo, Japan

[73] Assignee: Sony Corporation, Tokyo, Japan

[21] Appl. No.: 613,731

[22] PCT Filed: Apr. 5, 1989

[86] PCT No.: PCT/JP89/00365

§ 371 Date: Dec. 5, 1990

§ 102(e) Date: Dec. 5, 1990

[51] Int. Cl.[5] ..... H01J 31/15; H01J 29/70

[52] U.S. Cl. ..... 313/497; 313/422; 315/169.1

[58] Field of Search ..... 313/422, 495, 496, 497; 315/169.1

[56] References Cited

U.S. PATENT DOCUMENTS

| | | | |
|---|---|---|---|
| 4,404,493 | 9/1983 | Nonomura et al. | 313/422 |
| 4,618,801 | 10/1986 | Kakino | 313/495 |
| 4,727,284 | 2/1988 | Ohkoshi et al. | 313/495 |
| 4,893,056 | 1/1990 | Hara et al. | 313/495 |
| 4,970,430 | 11/1990 | Kamogawa et al. | 313/495 |
| 4,973,888 | 11/1990 | Morimoto et al. | 313/422 |

FOREIGN PATENT DOCUMENTS

| | | |
|---|---|---|
| 55-33734 | 3/1980 | Japan . |
| 61-135029 | 6/1986 | Japan . |

*Primary Examiner*—Donald J. Yusko
*Assistant Examiner*—John Giust
*Attorney, Agent, or Firm*—Hill, Steadman & Simpson

[57] ABSTRACT

The present invention relates to a fluorescent display apparatus of high brightness illumination which is applied to a display apparatus of large picture screen or the like. The display apparatus of the present invention is comprised of a plurality of segments (13) to which a high voltage is applied, a cathode (K), a plurality of control electrodes (G2) disposed in correspondence with each of the respective segments (13) and a common electron beam deriving means (G1) disposed between the cathode (K) and the control electrodes (G2) in correspondence with the plurality of segments (13R), (13G) and (13B), whereby the segements (13) are selectively illuminated by controlling the voltages of each of the control electrodes (G2). Thus, these electrodes can all be shaped as flat plates without causing a cross-talk and the structure of the display apparatus can be simplified.

2 Claims, 5 Drawing Sheets

FLUORESCENT DISPLAY APPARATUS WITH FIRST, SECOND AND THIRD GRID PLATES

TECHNICAL FIELD

The present invention relates to a fluorescent display apparatus of high brightness illumination.

BACKGROUND ART

A large display apparatus is known, in which a number of luminescent display cells having so-called phosphor trios formed of, for example, three colors of red, green and blue phosphor segments are arranged in a two-dimensional manner to thereby produce a large picture screen. In this display apparatus, the luminescent display cells are illuminated stably at high brightness, whereby a clear picture of sufficient brightness can be reproduced even outdoors.

Conventionally, such a luminescent display cell 6 is constructed as shown in FIG. 7. That is, three phosphor segments 2R, 2G and 2B which are illuminated in red, green and blue colors are formed on the inner surface of a front panel 1*a* of a glass housing, and three line-shaped cathodes K (KR, KG and KB) and three first grids (control electrodes) G1 (G1R, G1G and G1B) are formed on a rear panel 1*b* side in an opposing relation to the respective segments 2R, 2G and 2B. Further, a second grid (accelerating electrode) G2 is provided common to the three first grids G1R, G1G and G1B. A separator 3 formed of a conductive material to which an anode voltage is applied is disposed so as to enclose the respective phosphor segments 2R, 2G and 2B. In this case, in order to independently turn ON and OFF the adjacent phosphor segments 2R, 2G and 2B without cross-talk, the first grids G1R, G1G and G1B are shaped such that mesh-shaped opening portions 4R, 4G and 4B are formed on their cylindrical surfaces so as to encircle the corresponding line-shaped cathodes KR, KG and KB, respectively. The common second grid G2 is shaped as a flat plate configuration which has mesh-like openings 5R, 5G and 5B at its positions corresponding to the first grids G1R, G1G and G1B.

In this luminescent display cell 6, an anode voltage of, for example, about 8 kV is supplied to the phosphor segments 2R, 2G and 2B, a voltage of, for example, 0 V (OFF) to 5 V (ON) is applied to the first grids G1R, G1G and G1B, and a voltage of, for example, about 50 V is applied to the second grid G2. When the voltage of, for example, about 5 V is applied to the first grid G1, an electron beam from the cathode K is traveled through the first grid G1, is accelerated by the second grid G2 and impinges upon the corresponding phosphor segments 2R, 2G and 2B so that these phosphor segments are illuminated. When 0 V is applied to the first grid G1, the electron beam from the cathode K is cut off so that the corresponding phosphor segments are not illuminated. As such luminescent display cell 6, a so-called 8-element display cell, in which 8 sets of red, green and blue phosphor segments of three colors are integrally provided or 2-element display cell or the like is proposed (see Japanese Patent Application No. 60-191703).

Incidentally, in such luminescent display cell, it is requested to simplify its structure. For example, when the luminescent display cell is formed of much more elements, it is preferable that its structure is simplified more from a manufacturing-process standpoint. To this end, it is proposed that the first grid G1, for example, is shaped as a flat plate. If the first grid is simply shaped as a flat plate, the cathode, which should be placed in a cut-off state in the ON-OFF control operation, is affected by the adjacent first grid G1 which is placed in its ON state. As a result, a cross-talk to the adjacent phosphor segment occurs unavoidably. Further, the number of line-shaped cathodes cannot be reduced more than the number of phosphor segments, which provides a serious problem from a manufacturing-process and money standpoint.

In view of the above-mentioned aspect, the present invention is intended to provide a fluorescent display apparatus of simple structure which can be illuminated with high brightness and which can be controlled without cross-talk.

DISCLOSURE OF THE INVENTION

A fluorescent display apparatus of the present invention, as illustrated in FIGS. 1-3, comprises a plurality of phosphor segments 13 to which a high voltage is applied, a cathode K, a plurality of control electrodes G2 disposed in correspondence with the respective segments 13 and common electron beam deriving means G1 disposed between the cathode K and the control electrodes G2 in correspondence with the plurality of segments 13R, 13G and 13B, whereby voltages of the respective control electrodes G2 are controlled to selectively illuminate the phosphor segments 13.

In this case, when a spacing between the electron beam deriving means G1 and the control electrode G2 is selected as d12 and a spacing between the centers of the segments is selected as LG2, a relationship of $LG2 >> d12$ is satisfied.

Further, one common cathode K is provided for a plurality of segments 13R, 13G and 13B, and the plurality of control electrodes G2 and the electron beam deriving means G1 are shaped as flat plates.

An anode potential, for example, 5 kV is applied to the phosphor segment 13, a control potential, for example, 15 V (ON) to −2 V (OFF) is applied to the control electrode G2 and a positive potential, for example, 10 V is applied to the electron beam deriving means G1. In accordance with this arrangement, by the electron beam deriving means G1, uniform electron beams are always emitted from the cathode K and the electron beam passed through the electron beam deriving means G1 is controlled by a spatial potential of the control electrode G2. That is, if the voltage of 15 V is applied, for example, to the control electrodes G2G and G2B, the electron beams travel through the control electrodes G2G and G2B and impinge upon the corresponding phosphor segments 13G and 13B. At that time, if the voltage of −2 V is applied to the control electrode G2R, the electron beam is cut off and the corresponding phosphor segment 13R is not illuminated. At that time, since the spacing d12 between the control electrode G2 and the electron beam deriving means G1 is sufficiently smaller than the spacing LG2 between the centers of the segments, the electron beam cut off by, for example, the control electrode G2R is not affected at all by, for example, the adjacent control electrodes G2G and G2B which are turned ON. Thus, even if the electrodes are turned ON and OFF, no cross-talk occurs.

The control electrode G2 and the electron beam deriving means G1 are both shaped as the flat plates and one cathode K is commonly provided for the plurality of phosphor segments 13R, 13G and 13B, which can provide a simplified structure.

As described above, according to the present invention, in the luminescent display cell of high brightness illumination, since the common electron beam deriving means is provided between the cathode and the control electrodes, the occurrence of cross-talk can be avoided and all of these electrodes can be shaped as flat plates. Further, the number of cathodes is reduced more than the number of picture elements, i.e. the number of phosphor segments so that the overall arrangement can be simplified. Accordingly, this kind of fluorescent display cell can be manufactured with ease, the quality and reliability thereof can be increased. Further, a cost thereof can be reduced. Since the present invention is simplified in structure, this invention is suitably applied to a multi-element fluorescent display cell.

BEST MODE FOR CARRYING OUT THE INVENTION

An embodiment of the fluorescent display apparatus according to the present invention will be described hereinafter with reference to the drawings.

Figure 1:
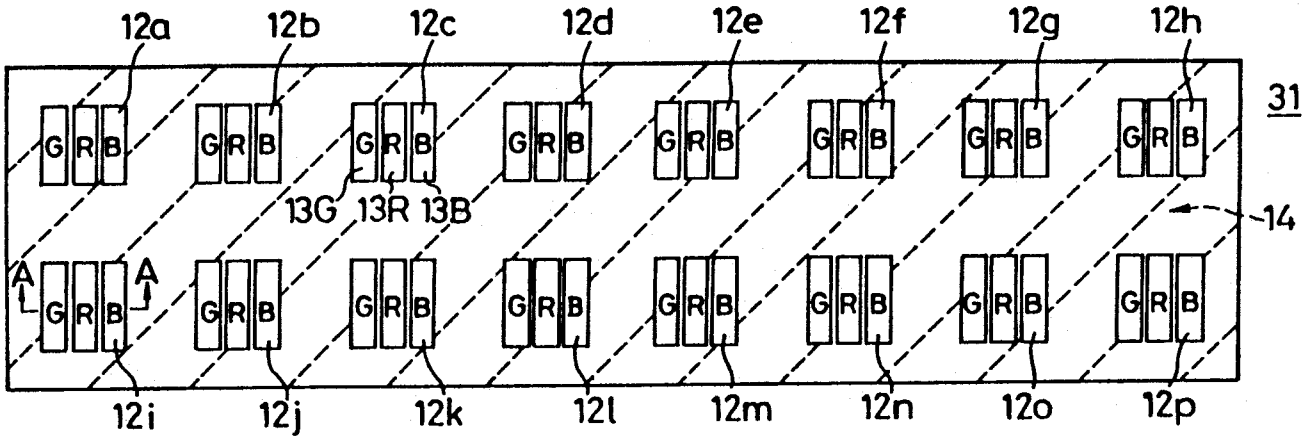
FIG. 1 is a front view showing an embodiment of a fluorescent display cell according to the present invention.
Figure 2:
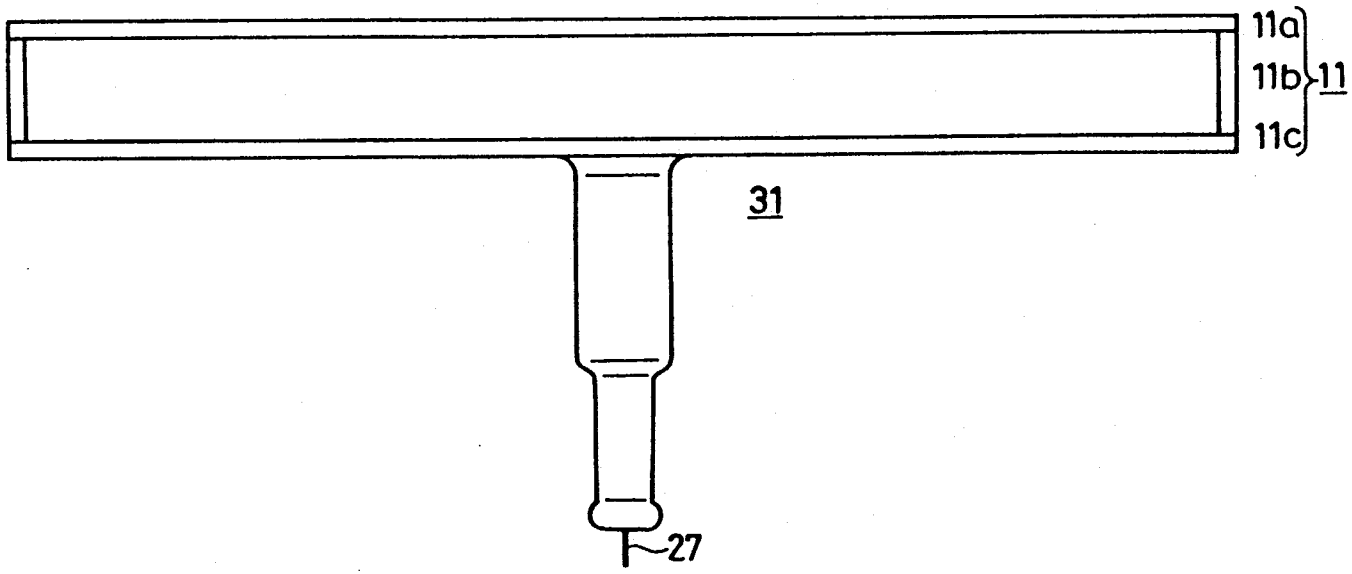
FIG. 2 is a side view thereof.
Figure 3:
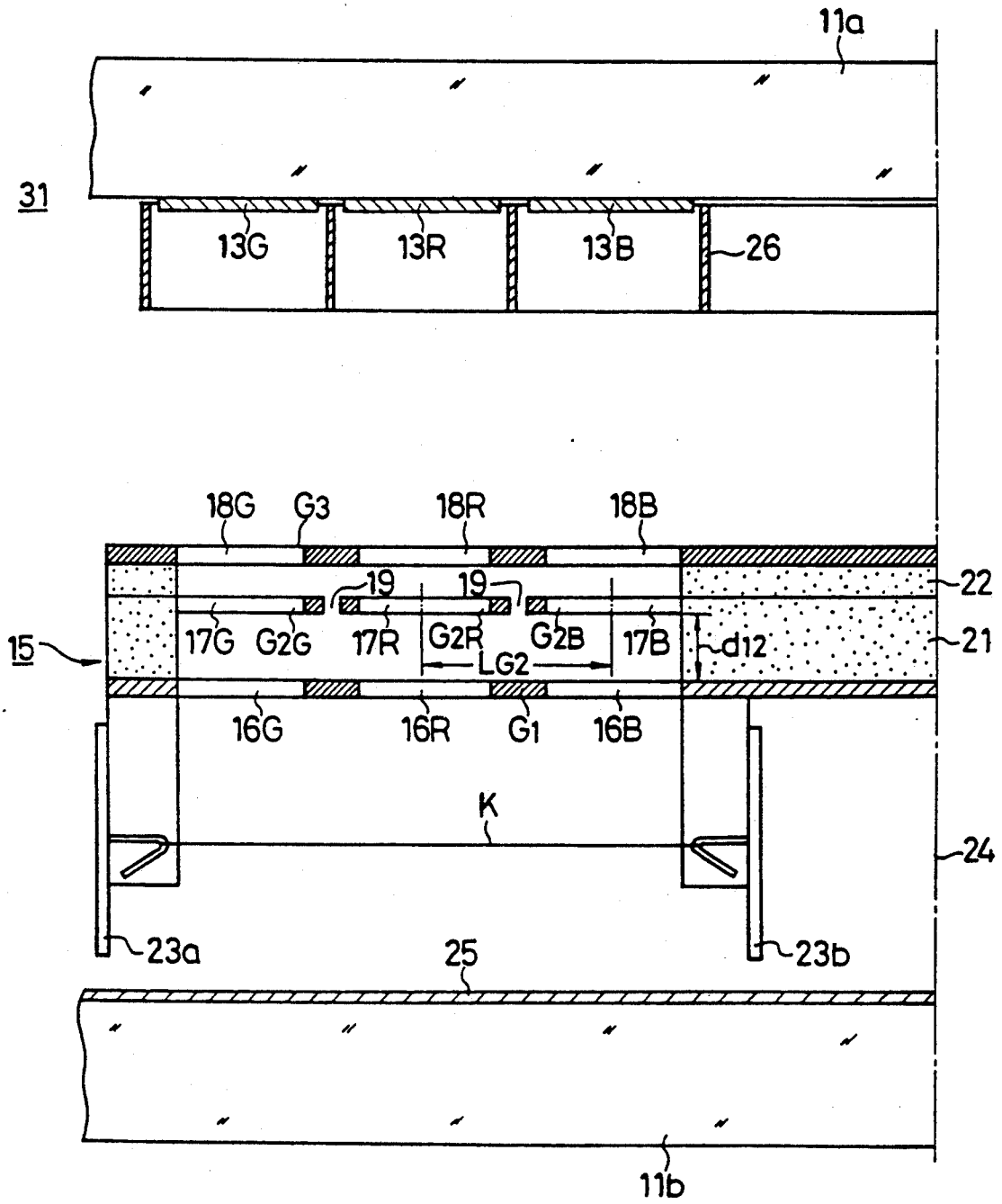
FIG. 3 is a cross-sectional view taken along the line A—A of FIG. 1.

FIGS. 1, 2 and 3 are diagrams of the fluorescent display apparatus of the present invention, and particularly, are a front view illustrating a unit cell thereof, a side view thereof and a cross-sectional view taken along the line A—A thereof.

In the figures, reference numeral 11 designates a glass housing which is composed of a front panel 11*a*, a rear panel 11*b* and a side plate 11*c*. Within this glass housing 11, the display has a plurality of sets of fluorescent display portions which are formed of phosphor layers, i e. in this embodiment, 16 sets of fluorescent trios 12 (12*a* to 12*p*) and electrode portions 15 corresponding to these fluorescent trios 12. The 16 sets of fluorescent trios 12 are formed by depositing phosphor on the front surface layers and 8 sets of fluorescent trios are arranged as two rows in the up and down direction. In this case, each fluorescent trio 12 is formed of three phosphor segments 13 of red, green and blue color illuminations, that is, phosphor layers 13R, 13G and 13B. More specifically, a carbon layer 14 which is a conductive layer of frame configuration is printed on the inner surface of the front panel 11*a*, and the red phosphor layer 13R, green phosphor layer 13G and blue phosphor layer 13B are printed in the corresponding vacant places within the frame-shaped portion so as to partially cover the carbon layer 14. A metal back layer made of, for example, aluminum is deposited on the red, green and blue phosphor layers through an intermediate layer. The electrode portion 15 is disposed on the rear panel 11*b* side so as to oppose the respective fluorescent trios 12. This electrode portion 15 comprises an one line-shaped cathode K commonly opposing to the red phosphor layer 13R, the green phosphor layer 13G and the blue phosphor layer 13B of the fluorescent trio 12, a common first grid (electron beam deriving means) G1 having mesh-like opening portions 16R, 16G and 16B provided at the positions opposing to the red, green and blue phosphor layers 13R, 13G and 13B, three independent second grids (control electrodes) G2 (G2R, G2G and G2B) having mesh-like opening portions 17R, 17G and 17B opposing to the red, green and blue phosphor layers 13R, 13G and 13B and a third grid G3 having mesh-like opening portions 18R, 18G and 18B made common to the three second grids G2, in that order. The first grid G1, the second grid G2 and the third grid G3 are each shaped as a flat plate. In the third grid G3, a portion corresponding to a spacing portion 19 between the second grids G2R, G2G and G2B is used as a shielding portion and the mesh-like opening portions 18R, 18G and 18B are formed on other portions corresponding to the respective opening portions 17R, 17G and 17B of the second grid G2. Similarly, in the first grid G1, the portion corresponding to the spacing portion 19 between the second grids G2 is employed as the shielding portion and the mesh-like opening portions 16R, 16G and 16B are formed on the portions corresponding to the respective opening portions 17R, 17G and 17B of the second grid G2.

Figure 5:
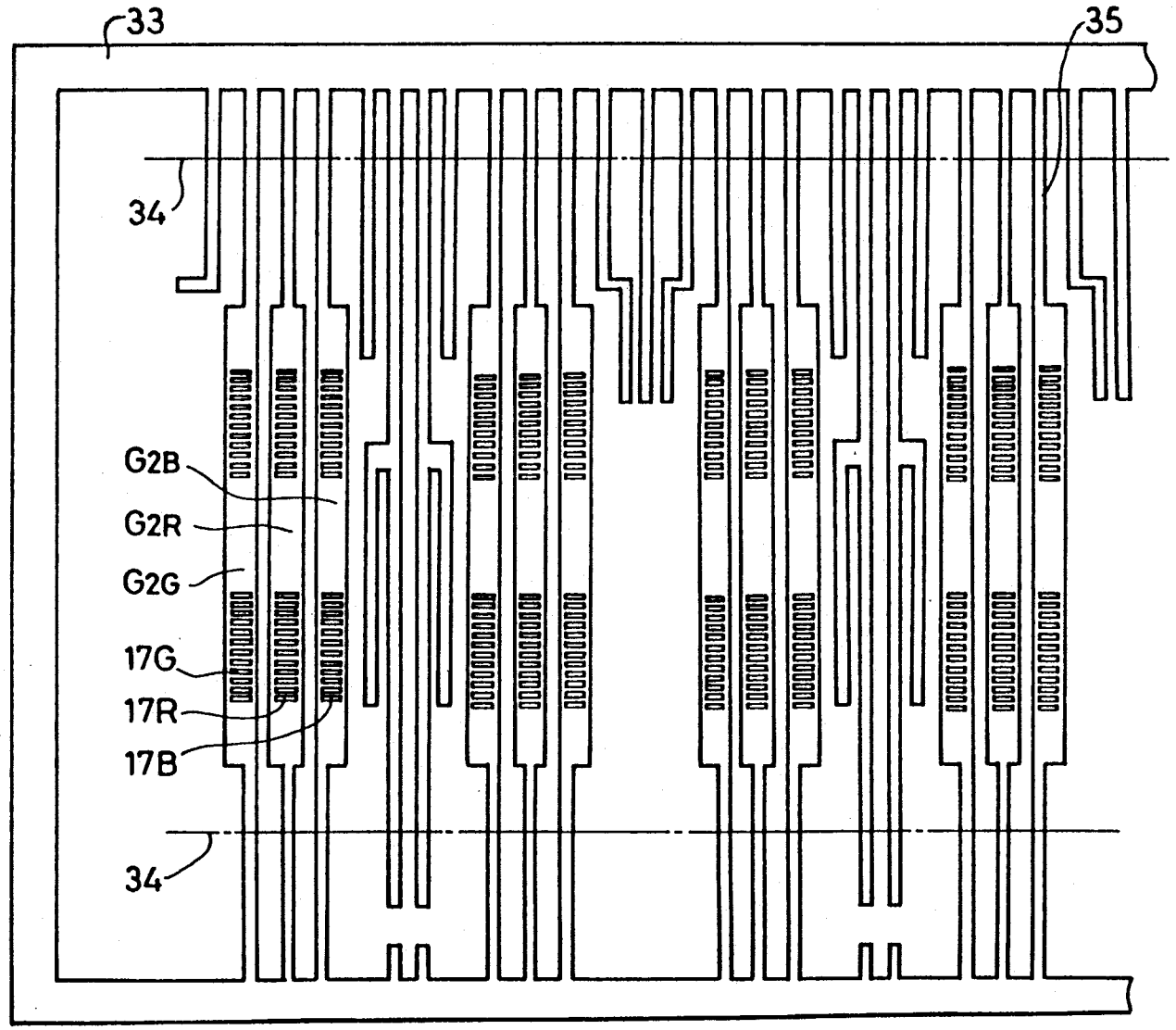
FIG. 5 is a plan view illustrating an example of a second grid according to the present invention.
Figure 7:
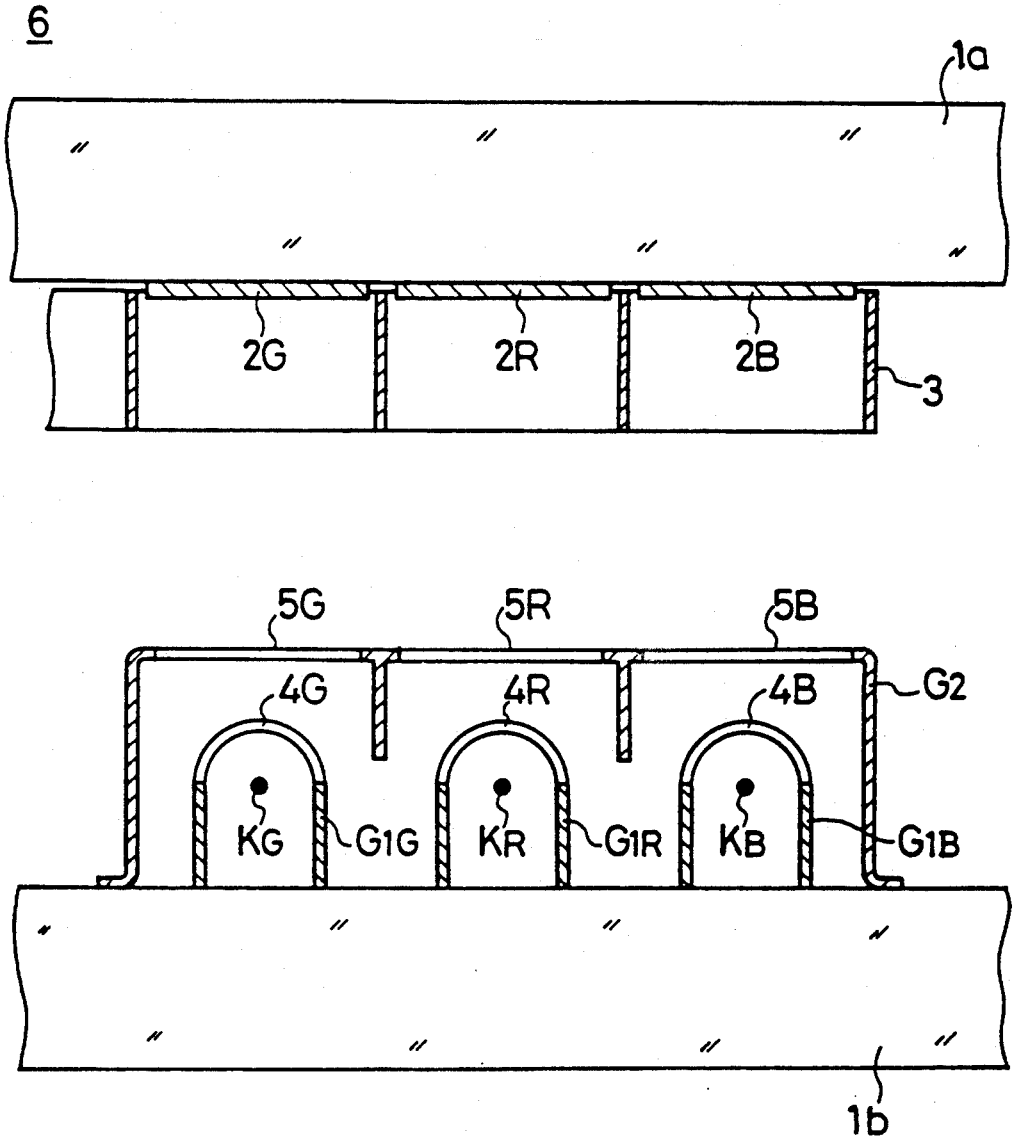
FIG. 7 (PRIOR ART)
FIG. 7 is a cross-sectional view of a main portion of a conventional fluorescent display cell.

The second grid G2 is supported between first and second ceramic structure members 21 and 22 in a sandwiched manner, the third grid G3 is supported on the upper second ceramic structure member 22 and the first grid G1 is supported to the lower surface of the first ceramic structure member 21. The independent second grids G2R, G2G and G2B are commonly formed integral with the two sets of fluorescent trios of the upper and lower rows of FIG. 1, that is, fluorescent trios 12*a*, 12*i* and 12*b*, 12*j*, . . . positioned within respective groove portions, though not shown formed on the upper surface of the first ceramic structure member 21 and are supported by the two ceramic structure members 21 and 22 in a sandwiched fashion. The second grid G2 is formed as a so-called lead frame structure 33 in which all portions corresponding to 16 elements are integrally coupled as shown in FIG. 5, and the second grid is single in the form of the lead frame structure 33 in the stage of the sealing-process. Then, the portion exposed to the outside after the sealing-process is cut along a one-dot chain line 34 to provide independent 24 grids G2R, G2G, G2B, and portions elongated from the respective grids G2R, G2G and G2B after the cutting-process are used to form a deriving lead portion 35. While the second grids G2 of all 16 elements are integrally formed to provide the lead frame structure in FIG. 5, other variant is also possible that the second grids G2 may be formed as a single lead frame structure for, for example, a plurality of elements each. The line-shaped cathode K is tensioned between conductive supporting members 23*a* and 23*b* attached to the first structure member 21. The ceramic structures 21 and 22 are made symmetrical in the left to right direction with respect to a center line 24 of, for example, FIG. 3, and the electrode portions 15 of 4 sets of upper and lower and right and left fluorescent trios are supported by the common ceramic structure members 21 and 22 to thereby form one block. The electrode portions of 4 blocks (corresponding to 16 so-called fluorescent trios)

are provided. As described above, the respective electrodes of the first grid G1, the second grid G2 and the third grid G3 are formed as a laminate structure through the ceramic structure members 21 and 22, and the spacing between the respective electrodes and the positions thereof are restricted automatically.

Figure 6:
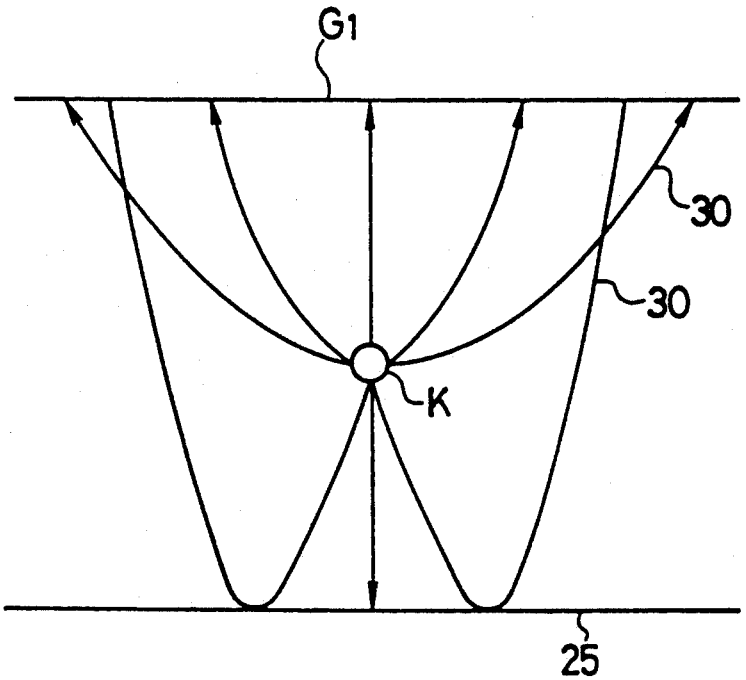
FIG. 6 is a diagram used to explain the operation of the present invention.

On the other hand, a rear surface electrode 25 to which a positive potential is applied is provided at the rear surface of the line-shaped cathode K. This rear electrode 25 acts to make the radiation of the electron beams 30 from the line-shaped cathode K uniform as shown in FIG. 6.

Further, a separator structure member 26 made of a conductive material is disposed so as to encircle each of the phosphor layers 13R, 13G and 13B of 16 sets of fluorescent trios 12. This separator structure member 26 is used to expand the electron beam so that the electron beam may impinge upon the entirety of the corresponding phosphor layer, i.e. to form a so-called diffusion lens and is also used as a feeding means for applying an anode voltage to each of the fluorescent trios 12 simultaneously.

While one line-shaped cathode K is provided for one fluorescent trio in this embodiment, it is possible from a principle standpoint that one line-shaped cathode K is provided for more than 2 fluorescent trios.

An operation of the display cell 31 (FIG. 3) will be explained.

Figure 4:
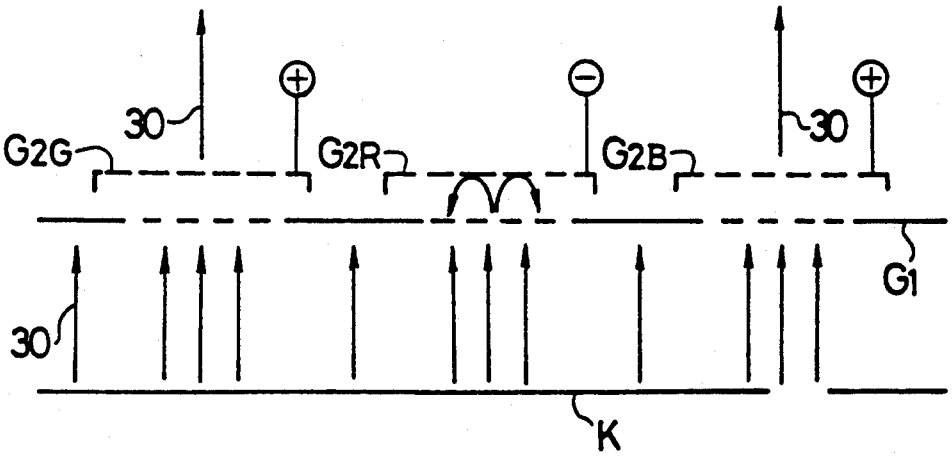
FIG. 4 is a schematic diagram used to explain an operation of the present invention.

An anode voltage of, for example, about 5 kV is supplied through an anode lead 27 (FIG. 2) and the separator structure member 26 (FIG. 3) to the red, green and blue phosphor layers 13R, 13G and 13B of each of the fluorescent trios 12. A voltage of, for example, 10 V is applied to the first grid G1, a voltage of, for example, 15 V (ON) to −2 V (OFF) is applied to the second grid G2 and a voltage of, for example, 0 V is applied to the third grid G3. Further, a voltage of 10 V is applied to the rear surface electrode 25. With this structure, the voltages on the anode side and the voltages of the first and third grids G1 and G3 are fixed so that the phosphor layers of respective colors, that is, the fluorescent segments 13 are selectively turned ON and OFF by the voltage applied to the second grid G2. In other words, as shown in FIG. 4, by the first grid G1, electron beams are uniformly radiated from the cathode K. Under this condition, if 15 V is applied to the second grid G2, for example, the grids G2G and G2B, the electron beams 30 travel through the second grids G2G and G2B to illuminate the phosphor layers 13G and 13B. If the voltage of −2 V is applied, for example, to the grid G2R, the electron beams 30 are cut off therein so that the phosphor layer 13R is not illuminated. In this case, the spacing d12 (FIG. 3) between the first grid G1 and the second grid G2 is sufficiently smaller than the spacing LG2 between the centers of the segments so that the electron beams cut off by the second grid G2R are not affected by the potentials of the second grids G2G and G2B which are placed in the ON state. Accordingly, a cross-talk in which the electron beams impinge upon the adjacent phosphor layer 13G or 13B does not occur. Since the third grid G3 is provided, the anode electric field can be prevented from entering the spacing 19 between the divided second grids G2 and therefore the occurrence of undesired beam can be suppressed. Further, although the second grids G2 are provided in the divided form so that they are not provided in parallel to each other accurately, the third grid G3 is disposed in the form of single common electrode plate, assuring that the third grid is disposed with good parallel degree. Accordingly, even when the second grids G2 are not disposed in parallel to each other with high accuracy, the electron beams, which passed through the second grid G2, accurately impinge upon the corresponding phosphor layers by virtue of the third grid G3 which is disposed with good parallel property. Further, the radiation of electron beams from the line-shaped cathode K is made uniform by the rear surface electrode 25 so that, when the phosphor layers are illuminated, the phosphor layers can be illuminated uniformly. The switching of the elements (i.e. fluorescent trios) of the upper and lower rows can be performed by switching the potential of the cathodes K. Then, if a number of display cells 31 are arranged in a two-dimensional fashion, it is possible to construct a large display apparatus.

According to the above-mentioned arrangement, all electrodes of the first grid G1, the second grid G2 and the third grid G3 can be shaped as the flat plates without causing any cross-talk so that the respective grids G1, G2 and G3 can be integrally formed by, for example, the etching process and that they can be supported with ease. Particularly, since a number of second grid G2 are formed as the lead frame structure 33 and hence can be treated as one part in the assembly process, the manufacturing process becomes easy and the manufacturing cost is reduced. Since the second grid G2 and the deriving lead portion 35 are integrally formed as one body, the interconnection between the electrode and the lead portion becomes unnecessary. Since the second grid G2 integrally formed is freely positioned by the etching process or the like, the second grid can be made thin at high accuracy with ease. As described above, the efficiency of the manufacturing process can be considerably increased and the cost thereof can be reduced considerably. Further, since the number of cathodes K can be reduced more than the number of fluorescent segments, the display apparatus can be manufactured with ease and the quality and reliability of the display cell of this kind can be improved.

While the present invention is applied to the 16-element display cell in the above-mentioned embodiment, the present invention can be applied to other display cell formed of a plurality of elements or a single element display cell.

We claim:

1. A flat type luminescent display, comprising:

a flat type envelope having a face panel, side wall and back plate;

a plurality of segmented luminescent trios on an inner surface of said face panel;

a plurality of cathodes, each cathode disposed in a position in the envelope to uniquely correspond to one luminescent trio in said plurality of luminescent trios;

a first grid plate forming means for pulling out a separate electron beam from each cathode for each segment of the trio uniquely corresponding thereto, said first grid plate being positioned in the envelope adjacent the cathodes and having mesh-like portions corresponding to the segments of each luminescent trio;

a plurality of second grid plates being arranged separate from each other in the envelope by spacing portions, each second grid plate forming means for controlling the electron beam being emitted toward one segment of each luminescent trio, each second grid plate having a mesh-like portion corresponding to said segment;

a third grid plate being disposed in the envelope between said face panel and the second grid plates and forming means to obtain a stable electric field; and conductor separators surrounding each luminescent trio;

wherein, a relationship of LG2 and d12 is $$LG2 >> d12$$

wherein LG2 is a distance between the centers of adjacent segments, and d12 is a spacing between the first grid plate and the second grid plate.

2. A flat type luminescent display according to claim 1, wherein said first grid plate and said third grid plate have shield plate portions which are arranged at a position corresponding to the spacing portions between each of said second grid plates.

* * * * *